US005901851A

United States Patent [19]

Charpentier

[11] Patent Number: 5,901,851

[45] Date of Patent: May 11, 1999

[54] DEVICE FOR PACKAGING TWO SUBSTANCES

[76] Inventor: Georges Charpentier, 830 bis, chemin Hugues-Berenguier, F-06610 la Gaude, France

[21] Appl. No.: 08/798,481

[22] Filed: Feb. 10, 1997

Related U.S. Application Data

[63] Continuation of application No. PCT/FR96/00849, Jun. 5, 1996.

[51] Int. Cl.[6] ..... B65D 21/00

[52] U.S. Cl. ..... 206/581; 220/4.27; 220/23.83

[58] Field of Search ..... 206/581, 823, 206/818, 216, 577; 220/4.27, 4.21, 23.2, 23.4, 23.83

[56] References Cited

U.S. PATENT DOCUMENTS

| | | | |
|---|---|---|---|
| 2,589,349 | 3/1952 | Diefenbach | 206/818 X |
| 4,189,057 | 2/1980 | Morille | 220/23.4 |
| 5,115,916 | 5/1992 | Beasley et al. | 220/23.4 X |
| 5,630,523 | 5/1997 | Wright | 220/4.27 X |
| 5,669,503 | 9/1997 | Robin | 220/4.27 X |

*Primary Examiner*—Jacob K. Ackun
*Attorney, Agent, or Firm*—Merchant, Gould, Smith, Edell, Welter & Schmidt

[57] ABSTRACT

A device (1) for packaging two substances, particularly two cosmetic substances, comprising at least two bottles (3, 5) that have any given shape but are preferably substantially identical, each bottle being provided with a body defined by side walls (7) and a bottom wall (18), and comprising a neck (11) sealable with a cap (13). The device is characterized in that each bottle (3, 5) is secured to an intermediate connecting member (15, 15'). The intermediate connecting member (15) of one bottle comprises magnetic attachment means (29) engageable with the intermediate connecting member (15') secured to the other bottle, whereby the bottles (23, 5) may be releasably joined together.

8 Claims, 2 Drawing Sheets

FIG.1
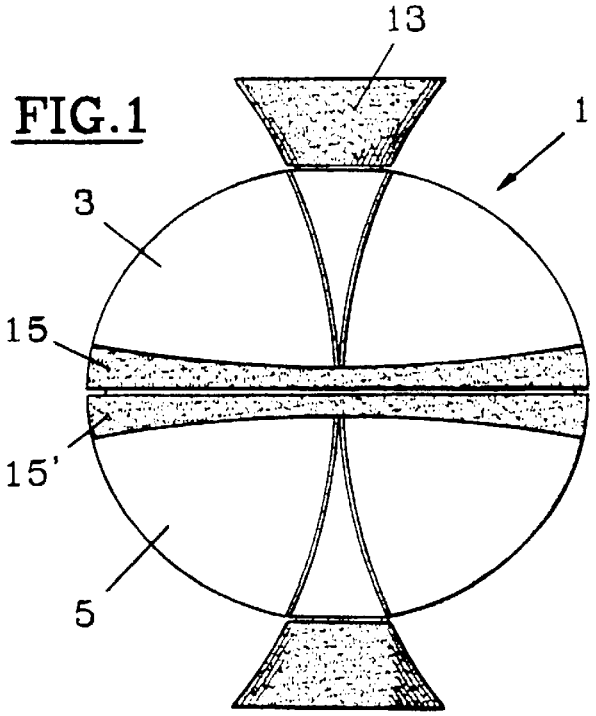
FIG.2
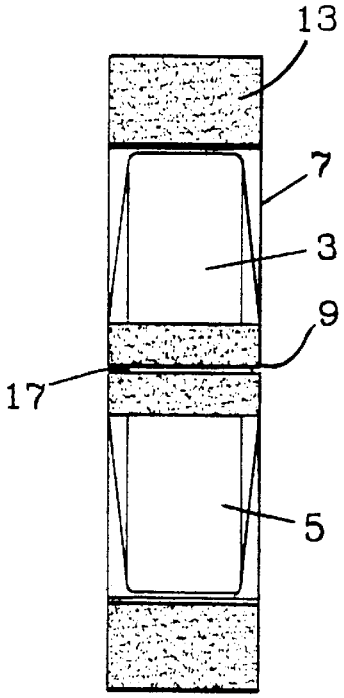
FIG.3A
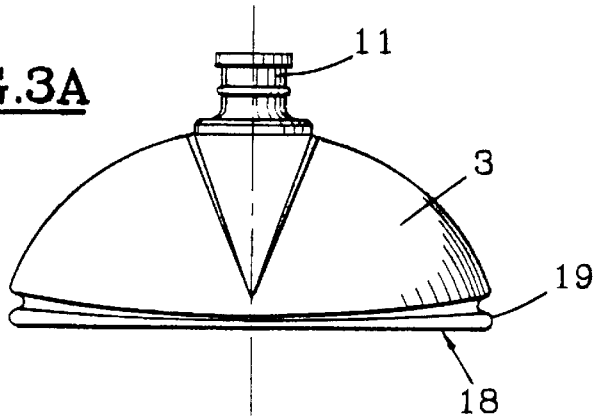
FIG.3B
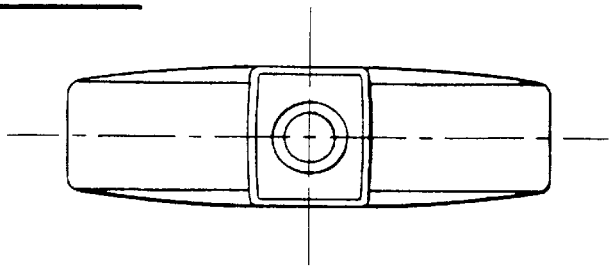
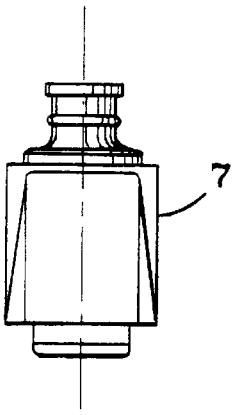
FIG.3C

DEVICE FOR PACKAGING TWO SUBSTANCES

This is a continuation application of PCT/FR96/00849 filed Jun. 5, 1996.

The present invention relates to a device for packaging two substances, especially two cosmetic substances, including two containers or bottles which have any shape but are preferably substantially identical, each one being provided with a body delimited by walls, and a neck which can be closed by a cap.

BACKGROUND OF THE INVENTION

Devices of the previously-described type are already known in the state of the art. Thus, the patent Fr-A-2 617 694 describes a device for packaging two substances, comprising two cylinders which are superposed and joined together by their respective bottom, particularly by molding so that they form just one piece, in such a way that the caps are at opposite ends from one another. However, one cylinder is made taller than the other, which makes them expensive and complicated to manufacture. Furthermore, these cylinders are not intended to be separated after they have been joined together.

Known elsewhere, from the patent FR-A-2 680 357, is a two-bottle packaging allowing two substances to be stored separately then mixed at the moment of use. Because the substances have to be mixed, the packaging comprises two bottles which are superposed but linked by an intermediate piece equipped with a hollow shaft. The lower bottle comprises a neck with fits into the hollow shaft and which pushes back a stopper so that the contents of the two bottles can be mixed. As can be seen, this two-bottle packaging meets a special need, which is that of mixing the substances, and therefore has a relatively complicated and expensive structure.

SUMMARY OF THE INVENTION

Given this state of the art, the object of the invention is to provide a device for packaging two substances which is of a very simple design and very simple to produce, while at the same time allowing flexible and easy use.

Another object of the invention is to provide a device for packaging two substances which is particularly economical to manufacture and wherein separating or joining together the constituent containers or bottles is very easy.

To this end, the invention relates to a device for packaging two substances, particularly two cosmetic substances, comprising at least two bottles of any shape but are preferably substantially identical, each bottle having a body defined by side walls and a bottom wall, and comprising a neck which can be closed by a cap, wherein each bottle is secured to an intermediate connecting member, the intermediate connecting member of a first bottle comprising means for connecting magnetically to an intermediate connecting member of another bottle, so that a removable magnetic connection between two bottles may be achieved.

According to other advantageous features of the invention:

said intermediate connecting members are fixed securely to a bottom wall of each bottle.

said intermediate connecting members comprise side faces provided with a rim which is intended to interact with a shoulder formed at the base of each bottle, so that an intermediate connecting member may be clipped onto the bottom of a bottle.

said means for connecting magnetically consist of at least one magnetic pellet embedded in corresponding housings of the intermediate connecting members.

the lower face of each intermediate connecting member comprises a plurality of recesses and of protrusions located in such a way that when the bottles are in the assembled position, the protrusions enter the corresponding recesses in such a way as to center one bottle with respect to the other.

each intermediate connecting member comprises an opening at the bottom of the housing accommodating said magnetic element.

the magnetic elements are selected to be such that the force of attraction generated between the bottles ensures that one bottle sticks to the other, it being possible for this sticking to be disrupted using a moderate amount of effort.

the cap of at least one bottle preferably comprises a flat top face forming a supporting surface on which the whole packaging device can rest.

BRIEF DESCRIPTION OF THE DRAWINGS

The invention will be described in greater detail with the aid of the drawings appended hereto, in which:

FIG. 1 represents an elevation view of an example of a packaging device according to the invention;

FIG. 2 represents a side view of the packaging device of FIG. 1;

FIGS. 3A, 3B, 3C represent respectively front, top and side views of a bottle of the type used to produce the packaging device according to the invention;

DETAILED DESCRIPTION OF THE DRAWINGS

Figure 4A:
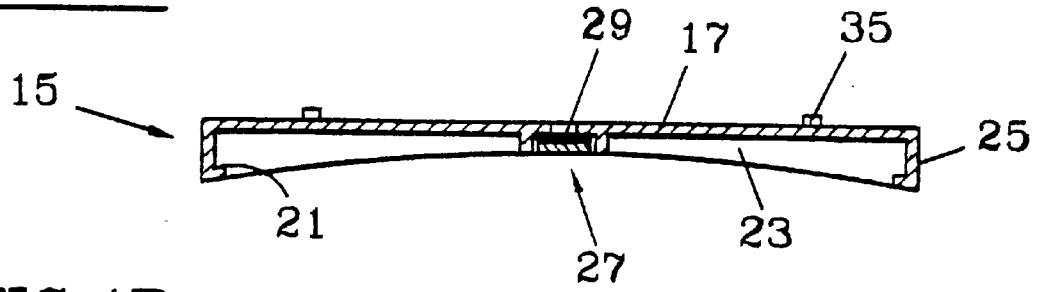
FIGS. 4A and 4B represent respectively an elevation view of and a section through an intermediate connecting member which can be fitted onto a wall of the bottle of FIG. 3, and two such connecting members joined together.

Reference is made to FIG. 1. This figure represents a preferred embodiment of the packaging device 1 according to the invention, in the assembled configuration. It should be noted that this is merely one embodiment, it being understood that the invention applies to bottles of varying shapes and sizes, or bottles joined together by walls other than the bottom walls, such as by the side walls. It should also be noted that the invention is described by way of example within the context of a use with cosmetic substances, particularly perfumes, it being clearly understood that the concept of the invention may be readily applied to other complementary substances, especially in the sphere of foodstuffs (containers for pepper and salt; sauce bottles, etc.).

The packaging device 1 mainly comprises two bottles or containers 3, 5 which are each intended to receive a substance, especially a cosmetic substance in the form of a liquid, such as a perfume. There are many circumstances under which presentation in two bottles is attractive, particularly when supplying two different or complementary cosmetic substances, or a version for women and a version for men of a product in one single packaging. Each bottle comprises a body defined by side walls 7, preferably including at least one substantially flat wall, for example a flat bottom 9, as well as an opening 11 closed by a cap 13, for example a screw cap.

The two bottles 3, 5 are joined together by one of their walls, for example at their bottom 9, by means of an intermediate connecting member 15, 15' having a lower connecting face 17, especially a flat face.

Reference is made to FIGS. 3, where one example of a bottle 3 which can be used within the context of the invention is represented. This bottle comprises a body defined by side walls 7 and a bottom wall 18, and this body comprising a neck 11 on the opposite side to the bottom wall 18. The latter preferably has a protrusion 19 on at least two opposite side walls, this protrusion 19 being intended to interact with a corresponding rim 21 of an intermediate connecting member 15, as explained later.

A bottle 3 like the one represented may easily be obtained by molding, as is well known to those skilled in the art.

The packaging device 1 according to the invention preferably includes an assembly of exactly identical bottles 3, 5, which makes it possible to reduce the manufacturing cost and increase the ease of assembly. However, it is perfectly conceivable to assemble two bottles which have different shapes but each of which is provided with a similar intermediate connecting member 15.

The intermediate connecting member 15 represented in section in FIG. 4A, produced, for example, by stamping metal or by molding, comprises two side ridges 23 shaped to suit the shape of the base 18 of the bottle 3, 5, two side ridges 25 equipped with the rims 21 intended to interact by clipping with the protrusions 19 of the base part of the bottle, and a lower face 17 (with respect to the upright orientation of a bottle) which is preferably flat and is intended to interact with the corresponding lower face 17 of the connecting member 15 forming part of the second bottle 5 of the packaging device 1 represented in FIG. 1.

Figure 4B:
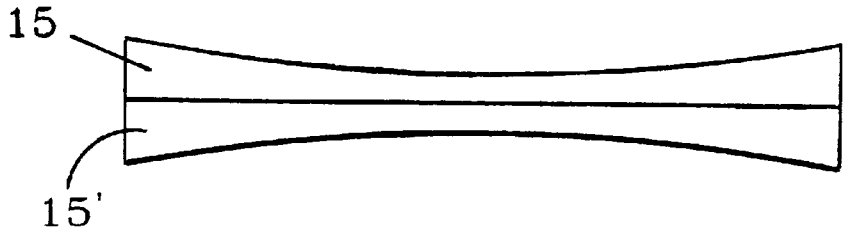

In order to provide a removable connection between two joined-together bottles 3, 5, the invention makes provision for the bottles 3, 5 or the intermediate connecting members 15, 15' to comprise magnetic connection means. To this end, the bottom 18 of the bottles, or preferably the intermediate connecting members 15, 15', comprise at least one housing 27 for accommodating a magnet 28, in the form of a magnetized pellet. Of course, the magnets 29 are arranged in such a way that two bottles 3, 5 placed top-to-tail attract, so that the lower faces 17 of the intermediate connecting members 15, 15' stick together under the effect of the attraction of the magnets, as represented in FIG. 4B.

It will be noted that in an advantageous embodiment of the invention at least one of the bottle caps (13) has a flat upper face forming a supporting surface on which the whole packaging device can rest.

The intermediate connecting members (15, 15') could especially be obtained by molding from a plastic, or alternatively by machining a more precious and harder material, allowing the connecting members to be re-used for new bottles if the first ones are empty. In this case, the shape of the lower part 18 of the bottles could easily be adapted to allow connection with the connecting members 15, 15' using a fixing method possibly other than clipping.

The magnetized pellets 29 will easily be selected by those skilled in the art on the basis of the characteristic shape and weight of the bottles so that the packaging device 1 can be handled without the two bottles inadvertently separating, but with it nevertheless being possible for them to be separated at will.

Figure 5A:
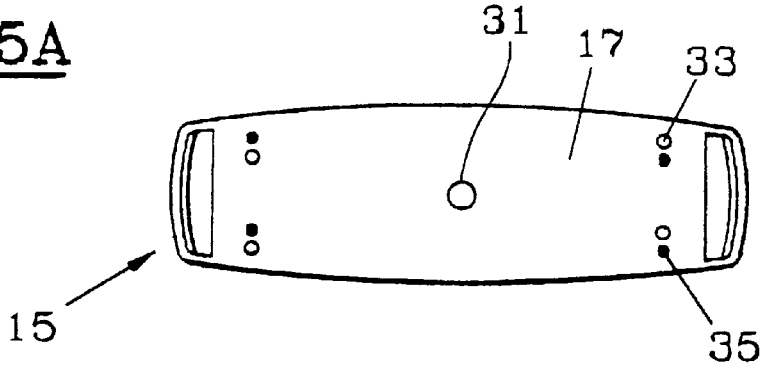
FIGS. 5A and 5B represent a connecting member of FIG. 4A, viewed from below and viewed from above, respectively.
Figure 5B:
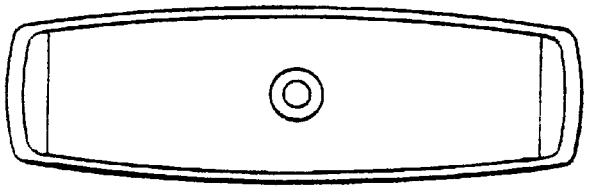

For preference, as represented in FIG. 5B, the lower face 17 of a connecting member 15, 15' is equipped with a small opening 31 opposite the housing 27 for the magnetized pellet 29, to make the fitting, removal or replacement of the magnet easier.

Furthermore, to guarantee good centering of the base of each bottle 3, 5 with respect to the other, the lower face 17 of each intermediate connecting member 15, 15' has centering means. In a simple and effective embodiment, these centering means are produced in the form of a plurality of recesses 33 and of projections 35. When these recesses 33 and projections 35 are arranged as represented in FIG. 5A, then joining two intermediate connecting members 15, 15' together via their lower faces 17 makes the recesses 33 of one of the connecting members interact with the projections 35 of the other member so that the respective faces 17 come into close contact without the possibility of sliding one with respect to the other in their plane, which makes it possible to ensure good centering of the two bottles.

It is clear from the foregoing that the packaging device according to the invention perfectly meets the stated objectives and makes it possible to obtain a packaging in two parts which are joined together by a very simple removable connection.

What is claimed is:

1. A device for packaging two substances, particularly two cosmetic substances, comprising:

at least two bottles of any shape, each bottle having a body with side walls and a bottom wall, and a neck closeable by a cap, wherein each bottle is secured to an intermediate connecting member, the intermediate connecting member of a first bottle comprising means for connecting magnetically to an intermediate connecting member of another bottle, so that a removable magnetic connection between the bottles may be achieved.

2. A device according to claim 1, wherein said intermediate connecting members are fixed securely to the bottom wall of each bottle.

3. A device according to claim 2, wherein said intermediate connecting members comprise side faces with a rim capable of interacting with a shoulder formed at a base of each bottle, so that an intermediate connecting member may be clipped onto the base of a bottle.

4. A device according to claim 1, wherein said means for connecting magnetically consist of at least one magnetic element embedded in corresponding housings of the intermediate connecting members.

5. A device according to claim 4, wherein a lower face of each intermediate connecting member comprises a plurality of recesses and protrusions located such that when the bottles are in an assembled position, the protrusions enter the corresponding recesses such that one bottle is centered with respect to the other.

6. A device according to claim 5, wherein each intermediate connecting member comprises an opening at a bottom of the housing accommodating said magnetic element.

7. A device according to claim 1, wherein the magnetic elements are selected such that the force of attraction generated between the bottles ensures that one bottle sticks to the other, it being possible to separate the bottles using a moderate amount of effort.

8. A device according to claim 1, wherein the cap of at least one bottle comprises a flat top face forming a supporting surface on which the device can rest.

* * * * *